US011378339B2

(12) United States Patent
Vouche et al.

(10) Patent No.: US 11,378,339 B2
(45) Date of Patent: Jul. 5, 2022

(54) THREE-STAGE HEAT EXCHANGER FOR AN AIR-COOLED CONDENSER

(71) Applicant: SPG Dry Cooling Belgium, Brussels (BE)

(72) Inventors: Michel Vouche, Marbais (BE); Christophe Deleplanque, Brussels (BE)

(73) Assignee: SPG Dry Cooling Belgium, Brussels (BE)

( * ) Notice: Subject to any disclaimer, the term of this patent is extended or adjusted under 35 U.S.C. 154(b) by 316 days.

(21) Appl. No.: 16/762,395

(22) PCT Filed: Nov. 2, 2018

(86) PCT No.: PCT/EP2018/080009
§ 371 (c)(1),
(2) Date: May 7, 2020

(87) PCT Pub. No.: WO2019/091869
PCT Pub. Date: May 16, 2019

(65) Prior Publication Data

US 2021/0041176 A1 Feb. 11, 2021

(30) Foreign Application Priority Data

Nov. 7, 2017 (EP) ..... 17200358

(51) Int. Cl.
*F02M 31/08* (2006.01)
*F28B 1/06* (2006.01)
(Continued)

(52) U.S. Cl.
CPC ..... *F28B 1/06* (2013.01); *F01D 25/12* (2013.01); *F28B 9/08* (2013.01); *F28D 1/0417* (2013.01)

(58) Field of Classification Search
CPC .... F28B 1/06; F28B 9/08; F01D 25/12; F28D 1/0417
(Continued)

(56) References Cited

U.S. PATENT DOCUMENTS 3,707,185 A * 12/1972 Modine ..... F25B 39/04 165/122
4,470,271 A * 9/1984 Draper ..... F25B 39/02 165/126
(Continued)

FOREIGN PATENT DOCUMENTS

EP 0794401 9/1997
EP 1548383 6/2005
(Continued)

OTHER PUBLICATIONS

International Searching Authority, "Search Report and Written Opinion." issued in connection with PCT patent application No. PCT/EP/2018/080009, dated Apr. 4, 2019, 10 pages.
(Continued)

*Primary Examiner* — Claire E Rojohn, III
(74) *Attorney, Agent, or Firm* — Hanley, Flight & Zimmerman, LLC

(57) ABSTRACT

The present invention relates to a V-shaped heat exchanger for condensing exhaust steam from a turbine. The V-shaped heat exchanger comprises primary, secondary and tertiary single-row condensing tubes placed in a V-shaped geometry. A steam supply manifold supplies the exhaust steam to lower ends of the primary tubes and steam that is not condensed in the primary tubes is collected at upper ends of the primary tubes and transported to the secondary tubes using top connecting manifolds. Steam that is not condensed in the secondary tubes is further transported to the tertiary tubes using a bottom connection manifold. The tertiary tubes
(Continued)

are coupled at their ends with an evacuation manifold for evacuating non-condensable gases.

19 Claims, 10 Drawing Sheets

(51) Int. Cl.
*F01D 25/12* (2006.01)
*F28B 9/08* (2006.01)
*F28D 1/04* (2006.01)

(58) Field of Classification Search
USPC ..... 165/52
See application file for complete search history.

(56) References Cited

U.S. PATENT DOCUMENTS

| | | | | |
|---|---|---|---|---|
| 4,903,491 | A * | 2/1990 | Larinoff | F28B 1/06 60/692 |
| 4,905,474 | A * | 3/1990 | Larinoff | F28B 9/10 165/113 |
| 7,096,666 | B2 | 8/2006 | Fay | |
| 10,527,354 | B2 * | 1/2020 | Vouche | F28B 9/02 |
| 10,907,900 | B2 * | 2/2021 | Bugler | F28D 1/05366 |
| 2005/0167093 | A1 * | 8/2005 | Schaefer | F28B 11/00 165/300 |
| 2015/0122455 | A1 * | 5/2015 | Fox | B21D 53/08 165/67 |
| 2017/0051981 | A1 * | 2/2017 | Singh | F28B 9/06 |
| 2017/0234168 | A1 * | 8/2017 | Scholz | F01K 9/003 60/690 |
| 2017/0363358 | A1 * | 12/2017 | Bugler, III | F28B 1/06 |
| 2018/0058463 | A1 * | 3/2018 | Rollins | F04D 29/059 |
| 2019/0093953 | A1 * | 3/2019 | Singh | F28F 19/02 |
| 2020/0309461 | A1 * | 10/2020 | Goldsmith, Jr | F28D 1/0435 |
| 2020/0318909 | A1 * | 10/2020 | Singh | F28B 9/02 |
| 2021/0210242 | A1 * | 7/2021 | Singh | G21C 19/07 |
| 2021/0254898 | A1 * | 8/2021 | Byrne | F28D 1/0443 |
| 2021/0278134 | A1 * | 9/2021 | Singh | F28D 1/024 |
| 2021/0302076 | A1 * | 9/2021 | Schumann | H02N 3/00 |
| 2022/0120478 | A1 * | 4/2022 | Kuppusamy | F28C 1/14 |

FOREIGN PATENT DOCUMENTS

| | | |
|---|---|---|
| FR | 1249717 | 12/1960 |
| JP | 11223419 | 8/1999 |

OTHER PUBLICATIONS

European PatEnt Office, "Decision to Grant," issued in connection with European patent application No. 17200358.4, dated May 4, 2020, 2 pages.

European PatEnt Office, "Intention to Grant," issued in connection with European patent application No. 17200358.4, Dec. 4, 2019, 101 pages.

European Pa I Ent Office, "Search report," issued in connection with European patent application No. 17200358.4, May 2, 2018, 5 pages.

* cited by examiner

THREE-STAGE HEAT EXCHANGER FOR AN AIR-COOLED CONDENSER

RELATED APPLICATIONS

This patent arises from the U.S. national stage of International Patent Application Serial No. PCT/EP2018/080009, having an international filing date of Nov. 2, 2018, and claims benefit of European Patent Application No. 17200358.4, filed on Nov. 7, 2017, which are hereby incorporated by reference in their entireties for all purposes.

FIELD OF THE INVENTION

The invention is related to a heat exchanger for condensing exhaust steam from a steam turbine of for example a power plant. More specifically, the invention is related to a V-shaped heat exchanger and to a W-shaped heat exchanger comprising two V-shaped heat exchangers.

The invention is also related to an air-cooled condenser (ACC) comprising a V-shaped heat exchanger or a W-shaped heat exchanger.

According to a further aspect of the invention, a method is provided for condensing exhaust steam from a steam turbine using an air-cooled condenser.

DESCRIPTION OF PRIOR ART

Various air-cooled condenser (ACC) types for condensing steam from a power plant are known in the art. These air-cooled condensers make use of heat exchangers formed by a number of finned condensing tubes arranged in parallel. The finned condensing tubes are in contact with the ambient air and when steam passes through the tubes, the steam gives off heat and is eventually condensed. Typically, a number of condensing tubes placed in parallel are grouped for forming a tube bundle. A heat exchanger can comprise multiple tube bundles.

Motorized fans located either below or above the tube bundles generate, respectively, a forced air draft or an induced air draft through the condensing tubes. In order to have a sufficient air volume to circulate, the fans and the heat exchanger are placed at a high elevation with respect to the floor level. Depending on the detailed design of the air-cooled condenser, elevations of for example 4 to 20 m are required.

The condensing tubes are placed in a vertical position or an inclined position with respect to a horizontal level. In this way, when condensate is formed in the condensing tubes, it can flow by gravitation to the lower tube end where condensate is collected in a drain that is coupled with a condensate collector tank.

A generally well known geometry for a heat exchanger is a geometry wherein the condensing tubes are positioned in a delta-shape geometry wherein the condensing tubes receive the exhaust steam from a top steam supply manifold that is connected at upper tube ends of the condensing tubes. In this geometry, when in operation, the steam and the condensate in the condensing tubes flow in the same direction, in a so-called co-current mode (also named parallel mode). A drain duct is coupled to lower ends of the condensing tubes for collecting the condensate. The condensing tubes of these heat exchangers can have a length of for example 10 to 12 meter.

An alternative geometry for a heat exchanger is a so-called V-shaped geometry wherein the condensing tubes are positioned in a V-shaped geometry. Such a V-shaped heat exchanger comprises a first set and a second set of condensing tubes that are inclined with respect to a vertical plane. An opening angle δ between the first set of tubes and the second set of tubes is formed wherein the opening angle δ has a typical value between 40° and 80°.

An example of a V-shaped based ACC is described in U.S. Pat. No. 3,707,185. In this example, multi-row condensing tubes are placed in a V-shaped geometry and the heat exchanger operates in a counter-current mode (also named counter-flow mode) wherein steam and condensate flow in an opposite direction. The steam supply manifold comprises a drain section to drain the condensate coming from each of the condensing tubes of the V-shaped heat exchanger. The upper tube ends of the condensing tubes are connected with vent valves to extract non-condensable gases. This heat exchanger is called a single stage heat exchanger as steam is condensed during one passage through a single condensing tube. In this V-shaped heat exchanger, as the steam supply manifold is supplying the exhaust steam to lower tube ends of the condensing tubes, the steam and the condensate flow in an opposite direction, i.e. a counter-current mode.

One of the problems with the single stage V-shaped heat exchanger described in U.S. Pat. No. 3,707,185 is that due to variable condensing rates in the multi-row tubes dead zones in the tubes can occur that fill up with non-condensable gases. This reduces the efficiency of the heat exchanger. In addition, due to this non-efficient evacuation of the non-condensable gases, freezing of condensate in the tube bundles can occur during winter and cause serious damage to the condensing tubes.

In patent publication U.S. Pat. No. 7,096,666, an ACC with a V-shaped heat exchanger is described wherein the V-shaped heat exchanger comprises single-row condensing tubes having a tube length of 10 meter. When in operation, this heat exchanger uses a two-stage condensing scheme. The condensing tubes of the first stage condenser are placed in a V-shaped geometry and are designed such that after a passage of the steam through a first condensing tube, not all steam is condensed. In U.S. Pat. No. 7,096,666, the steam that is not condensed during a first passage through a condensing tube is collected at the upper tube end and transported via a transfer pipe to a second stage condenser operating in a counter-current mode. This second stage condenser is positioned in a plane perpendicular to the above mentioned vertical plane and the second stage condenser uses dedicated fans for generating an air flow through the second stage condenser. The second stage condenser is configured to extract non-condensable gases.

One of the problems with the ACC described in U.S. Pat. No. 7,096,666 is that the first stage condenser, which is a V-shaped condenser, is complex and requires means for injecting the exhaust steam into both the lower and upper tube ends of the condensing tubes. The top connecting manifold is configured for both extracting and injecting steam and a transfer pipe is needed to transport the remaining steam towards the second condenser. The tubes of the second condenser are positioned vertically and incorporated in the end walls of the ACC. This ACC also needs dedicated support structure to support the second condenser and the dedicated fans of the second condenser. In U.S. Pat. No. 7,096,666, the condensing tubes of the first and the second stage condenser are also different. The condensing tubes of the first stage condenser require specific side steam extraction openings. Although the ACC of U.S. Pat. No. 7,096,666 provides for a solution for reducing the above mentioned dead zones and also provides a system to extract the non-condensable gases, the ACC has a drawback of being complex resulting in increased cost. Also, in view of the complexity and various equipment components and support structures needed, the time on site to assembly and erect this type of ACC is increased.

In US2017/0234168A1, an air-cooled condenser comprising V-shaped heat exchangers operating in a co-current mode is disclosed. Tube bundles, placed in a V-geometry, are connected with their upper ends to steam supply lines and a condensate collector is connected to the lower ends of the tube bundles. A drawback of the V-shaped heat exchanger disclosed in this document is that dedicated support structures are needed to support the tube bundles, the steam supply line and the condensate collectors as illustrated for example in FIG. 5 and FIG. 6 of US2017/0234168A1. Indeed, this V-shaped heat exchanger is mounted on a support bracket extending in a longitudinal direction parallel to the steam supply lines and the tube bundles are further supported by lateral struts and/or by a secondary triangular-shaped lattice support structure. The support bracket is attached to a central support pillar that is supporting a fan. A further drawback of this V-shaped heat exchanger is that the exhaust steam has to be supplied at a higher altitude as the steam is supplied to the tube bundles from the top and hence the system requires additional steam supply piping to bring the exhaust steam to the needed altitude. Such a complex support structure to support the V-shaped heat exchangers results in an increased cost of an air-cooled condenser and also results in an increased time to assemble the air-cooled condenser.

SUMMARY OF THE INVENTION

It is an object of the present invention to provide a new and improved robust heat exchanger that reduces the potential risk of freezing of condensate in the condensing tubes and that at the same time allows to build a cost-effective air-cooled condenser having a reduced production and installation time.

The present invention is defined in the appended independent claims. Preferred embodiments are defined in the dependent claims.

According to a first aspect of the invention, a V-shaped heat exchanger for condensing exhaust steam from a turbine is provided. Such a V-shaped heat exchanger comprises a first set of primary tubes and a second set or primary tubes. The primary tubes of the first set are single-row condensing tubes placed in parallel and inclined with an angle $\delta 1$ with respect to a vertical plane V, and wherein $15° < \delta 1 < 80°$, preferably $20° < \delta 1 < 40°$. The primary tubes of the second set are single-row condensing tubes placed in parallel and inclined with an angle $\delta 2$ with respect to the vertical plane, and wherein $15° < \delta 2 < 80°$, and wherein an opening angle $\delta = \delta 1 + \delta 2$ is formed between the first set of primary tubes and said second set of primary tubes.

The V-shaped heat exchanger comprises a steam supply manifold coupled with lower tube ends of the primary tubes of the first set of primary tubes and coupled with lower tube ends of the primary tubes of the second set of primary tubes. The steam supply manifold comprises a steam supply section for transporting the exhaust steam to the lower tube ends of the primary tubes of the first and second set of primary tubes, and a condensate drain section configured for draining condensate from the primary tubes of the first set and the second set of primary tubes.

The V-shaped heat exchanger according to the invention is characterized in that it comprises a first set of secondary tubes and a second set of secondary tubes. The secondary tubes of the first set are single-row condensing tubes placed in parallel and inclined with said angle $\delta 1$ with respect to the vertical plane V. The secondary tubes of the second set are single-row condensing tubes placed in parallel and inclined with said angle $\delta 2$ with respect to the vertical plane such that the opening angle $\delta = \delta 1 + \delta 2$ is formed between the first set of secondary tubes and the second set of secondary tubes.

The V-shaped heat exchanger comprises at least a first set of tertiary tubes, wherein the tertiary tubes of the first set are placed in parallel and inclined with the angle $\delta 1$ with respect to said vertical plane V, preferably the tertiary tubes are single-row condensing tubes.

The V-shaped heat exchanger according to the invention further comprises a first top connecting manifold, a second top connecting manifold, a bottom connecting manifold and at least a first evacuation manifold for evacuating non-condensable gases.

The first top connecting manifold is coupling upper tube ends of the primary tubes of the first set of primary tubes with upper tube ends of the secondary tubes of the first set of secondary tubes.

The second top connecting manifold is coupling upper tube ends of the primary tubes of the second set of primary tubes with upper tube ends of the secondary tubes of the second set of secondary tubes.

The bottom connecting manifold is coupled with lower tube ends of the secondary tubes of the first set of secondary tubes, coupled with lower tube ends of the secondary tubes of the second set of secondary tubes and coupled with lower tube ends of the tertiary tubes of the at least first set of tertiary tubes.

The at least first evacuation manifold for evacuating non-condensable gases is coupled with upper tube ends of the tertiary tubes of the at least first set of tertiary tubes.

The bottom connecting manifold comprises a draining means configured for draining condensate from the secondary tubes of the first set and the second set of secondary tubes and for draining condensate from tertiary tubes of the at least first set of tertiary tubes.

Advantageously, by coupling the condensing tubes as claimed, a three stage heat exchanger is formed wherein steam can flow in three consecutive condensing tubes and wherein non-condensable gases are efficiently evacuated. When in operation, in a first stage, the primary tubes of the first and second set of primary tubes operate in a counter-current mode where steam and condensate flow in an opposite direction. In a second stage, remaining steam that is not condensed in the first stage is further condensed in a co-current mode in the secondary tubes of the first and second set of secondary tubes. Finally, in a third stage, the tertiary tubes operate in a counter-current mode to condense further remaining steam that is not condensed during the first and second stage. The three stage condensation scheme allows for an effective evacuation of non-condensable gases through the evacuation manifold coupled to the upper tube ends of the tertiary tubes. Indeed, the non-condensable gases are driven along with the steam through the sequence of primary, secondary and tertiary tubes. The non-condensable gases end up in a top portion of the tertiary tubes where they are extracted. In this way, no dead zones are created in the condensing tubes and hence the risk of condensate freezing in the winter period is strongly reduced.

Advantageously, by placing all the tubes in a V-shaped geometry, the assembly work and erection work on site is facilitated. For example, the V-shaped heat exchanger with the condensing tubes, the top manifolds and the bottom steam supply manifold can first be pre-assembled and then be lifted as one entity and be placed on a support understructure.

Advantageously, by using a steam supply manifold supplying steam at the lower tube ends of the primary tubes, the steam supply manifold is located in the vertex region of the V-shaped heat exchanger. In this way, the steam supply manifold also acts as strengthening element and support element for the heat exchanger. For example, no additional support structures are needed to support the condensing tubes and the top manifolds.

In addition, a fan deck can be placed on top of the top manifolds and the weight of the fans can hence also be supported by the steam supply manifold. A further advantage of placing the primary, secondary and tertiary tubes in a V-shaped geometry is that the same fans, can be used for cooling the various tubes.

Advantageously, the same type of single-row condensing tubes can used for the primary, secondary and tertiary condensing tubes.

The invention also relates to a W-shaped heat exchanger for condensing exhaust steam from a turbine comprising a first V-shaped heat exchanger and a second V-shaped heat exchanger placed adjacently to the first V-shaped heat exchanger such that the steam supply manifold of the first V-shaped heat exchanger is positioned parallel with the steam supply manifold of the second V-shaped heat exchanger.

The advantage of using a W-shaped heat exchanger is that for example a single row of fans extending in the direction of the steam supply manifold can be placed on top of the heat exchanger. These fans can be configured to blow air in each of the two V-shaped heat exchangers. In this way, the number of fans that are needed can be reduced.

The invention further relates to an air-cooled condenser comprising a W-shaped heat exchanger. Such an air-cooled condenser comprises a fan configured for supplying cooling air to the W-shaped heat exchanger. The air-cooled condenser according to the invention further comprises a support understructure configured for elevating the W-shaped heat exchanger with respect to a ground floor. Advantageously, by lifting the steam supply manifolds, the entire W-shaped heat exchanger is lifted and hence the support understructure does not need a support bracket in the direction of the steam supply manifold as the steam supply manifolds itself act as longitudinal support structures.

According to a second aspect of the invention, a method for condensing exhaust steam from a turbine using an air-cooled condenser is provided as defined in the appended claims.

SHORT DESCRIPTION OF THE DRAWINGS

These and further aspects of the invention will be explained in greater detail by way of example and with reference to the accompanying drawings in which:

FIG. 1 schematically illustrates a side view of a part of a V-shaped heat exchanger according to the invention;

Figure 6A:
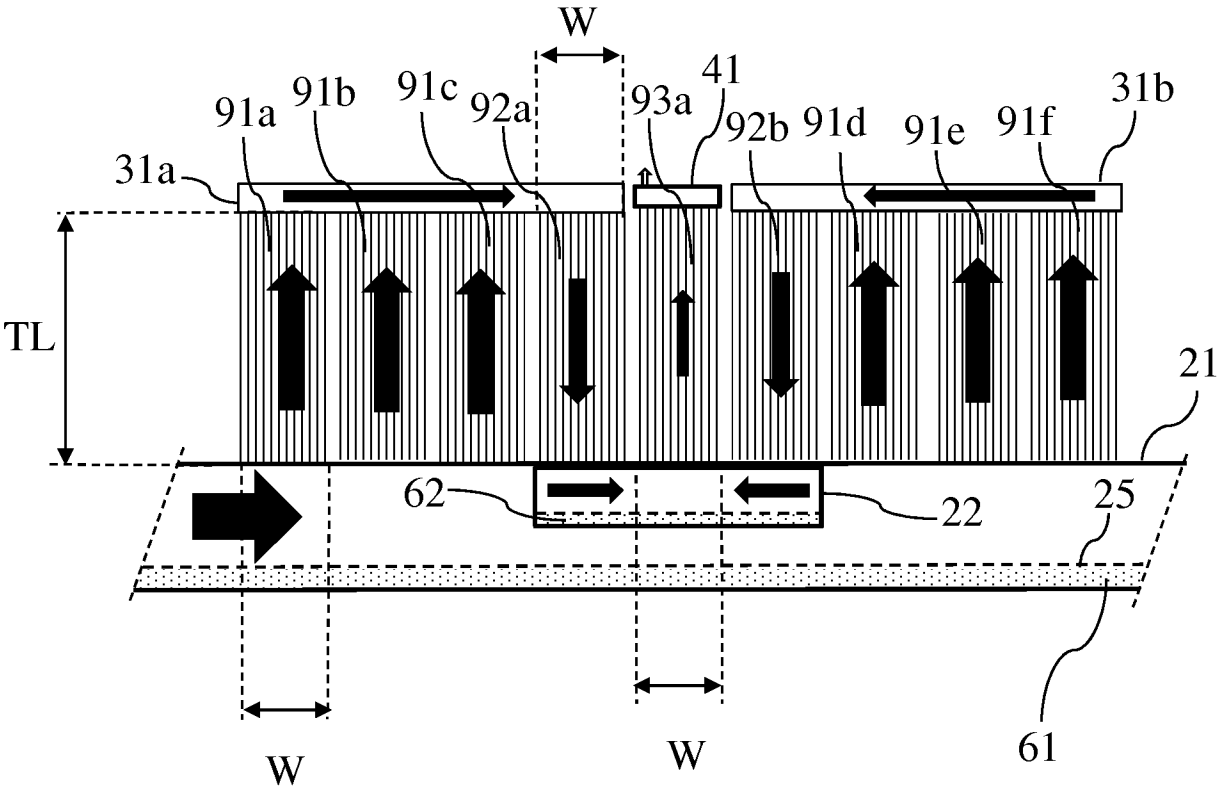
Figure 6B:
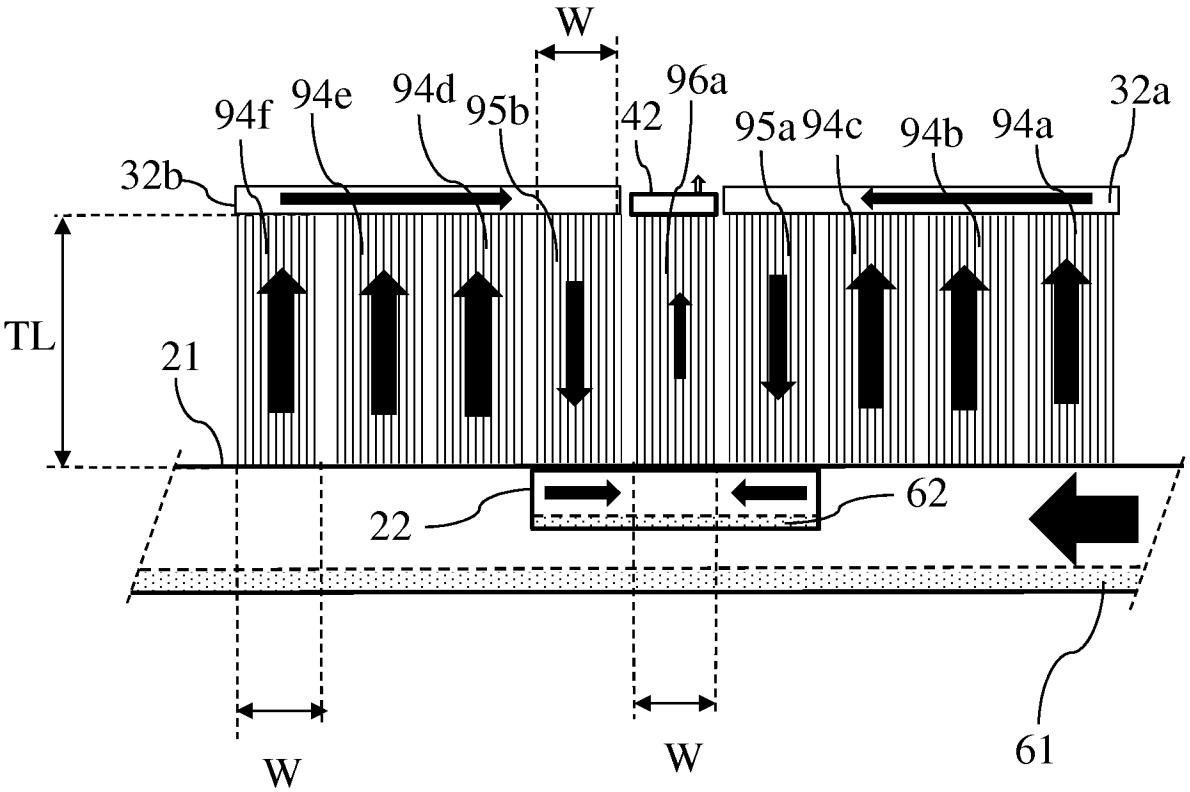

FIG. 6*a* schematically illustrates a first side view of a part of a further example of a V-shaped heat exchanger according to the invention;

FIG. 6*b* schematically illustrates a second side view of the V-shaped heat exchanger of FIG. 6*a;*

Figure 7:
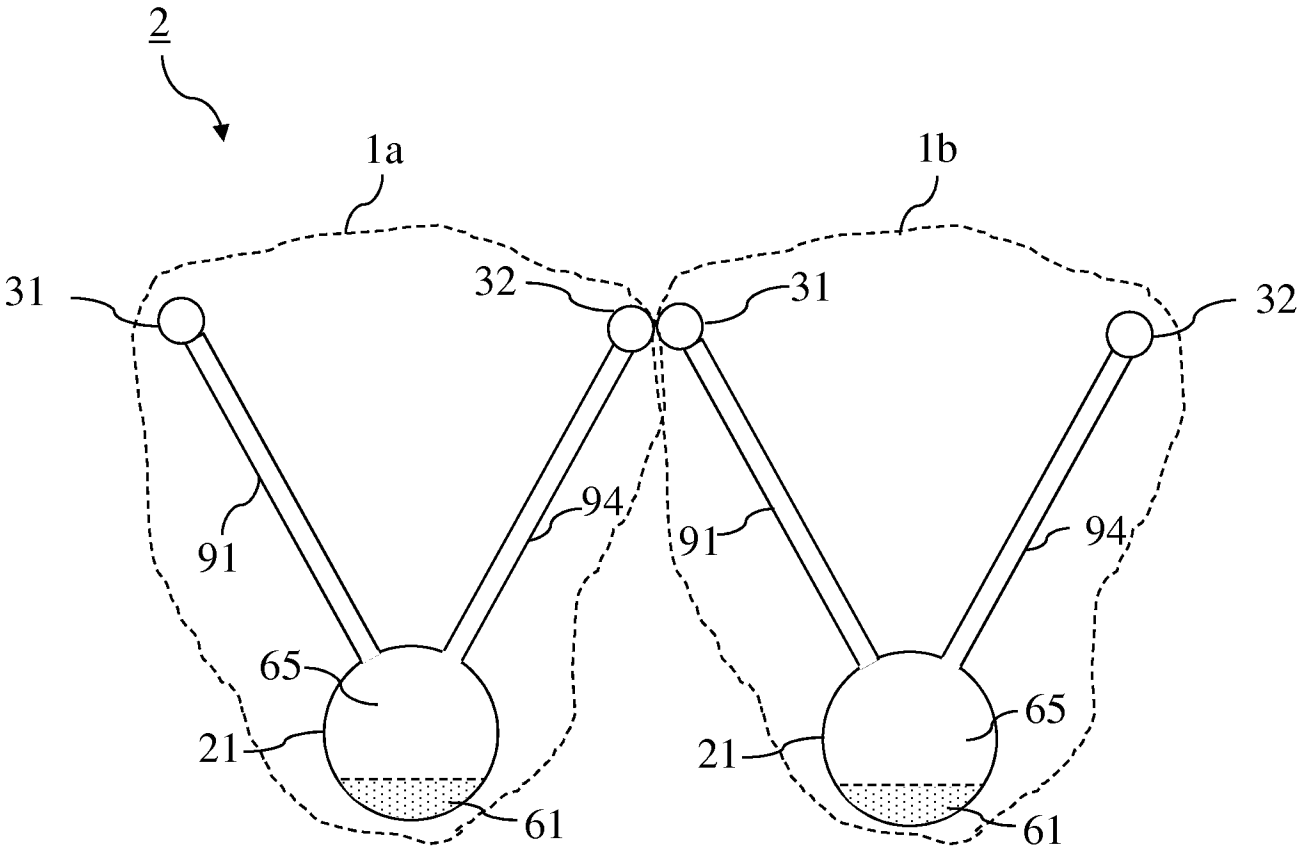
Figure 8:
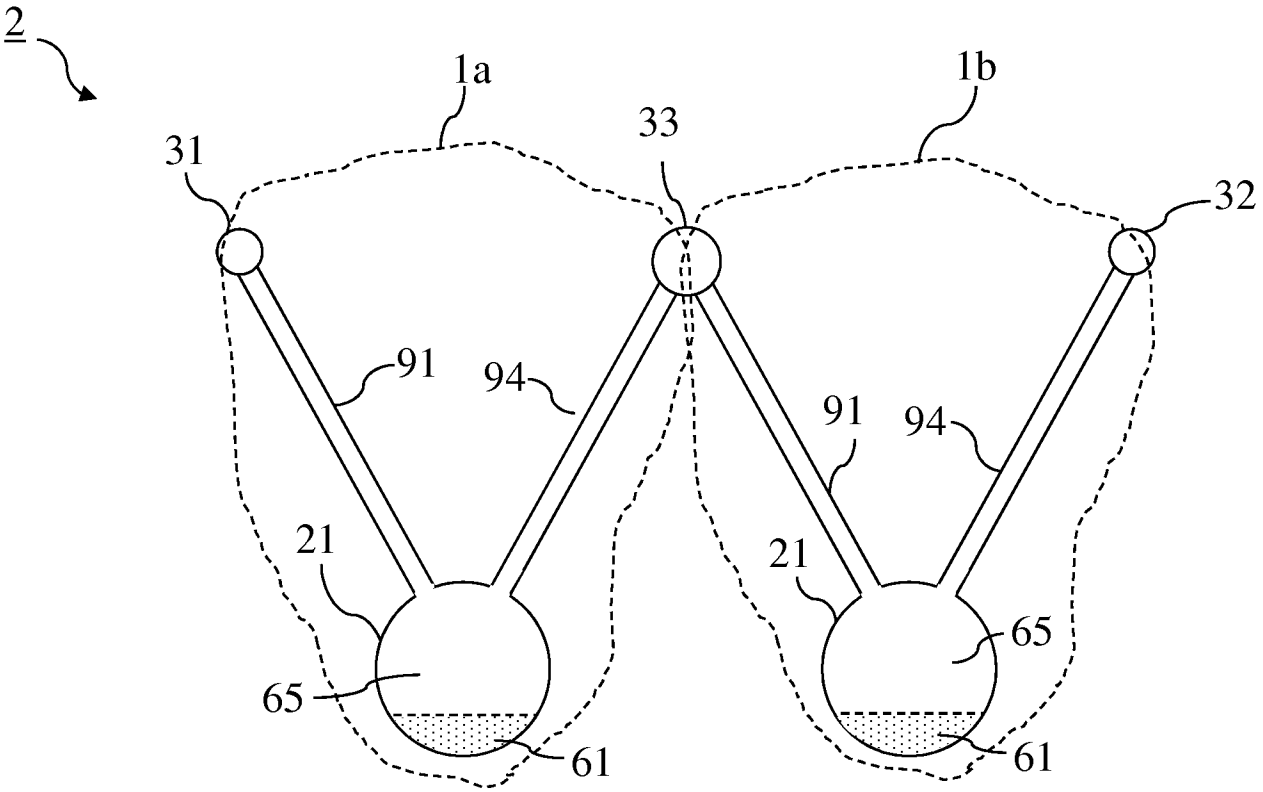
Figure 10:
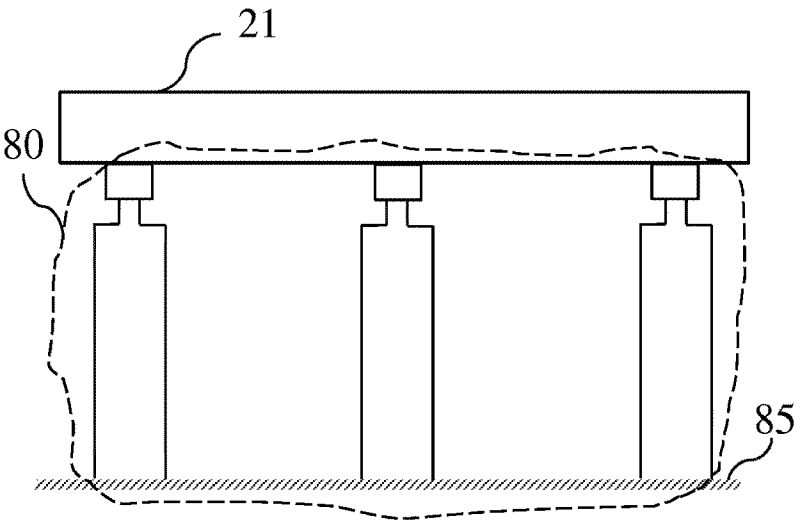
Figure 9:
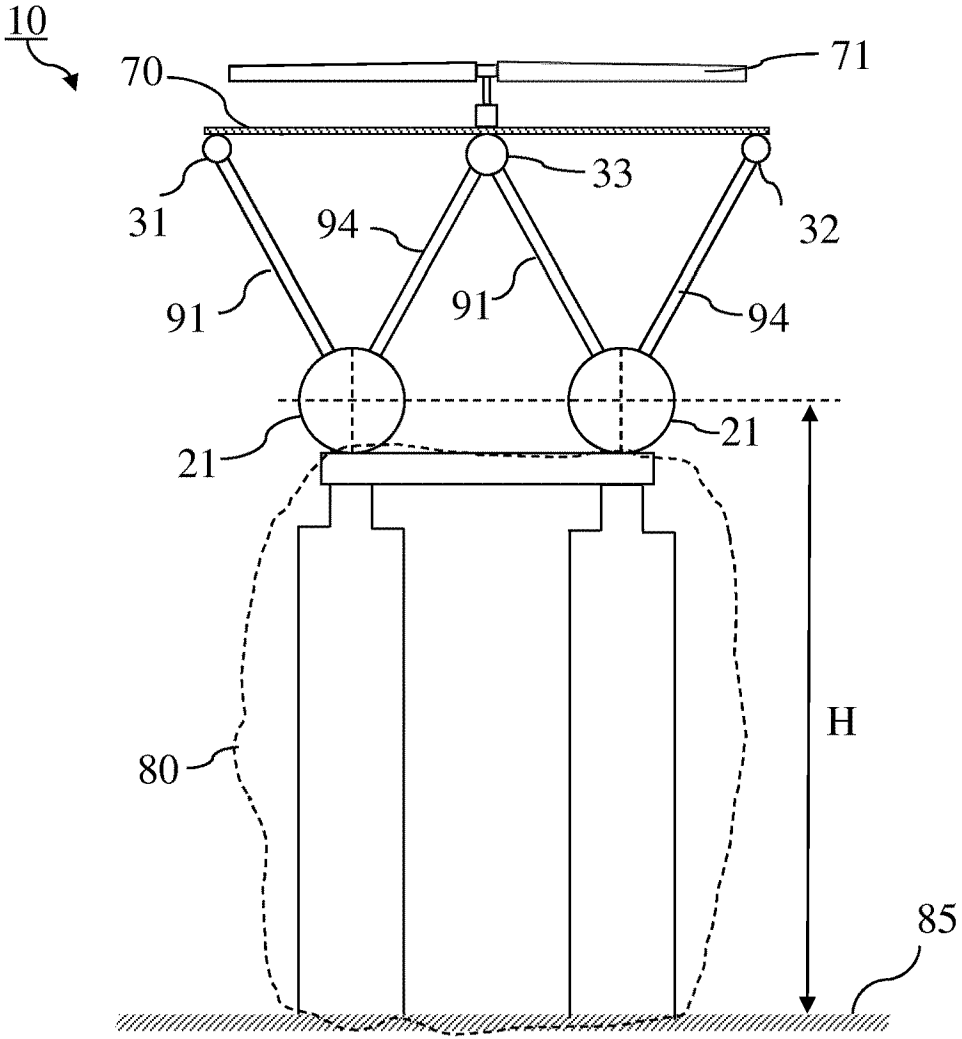
Figure 11:
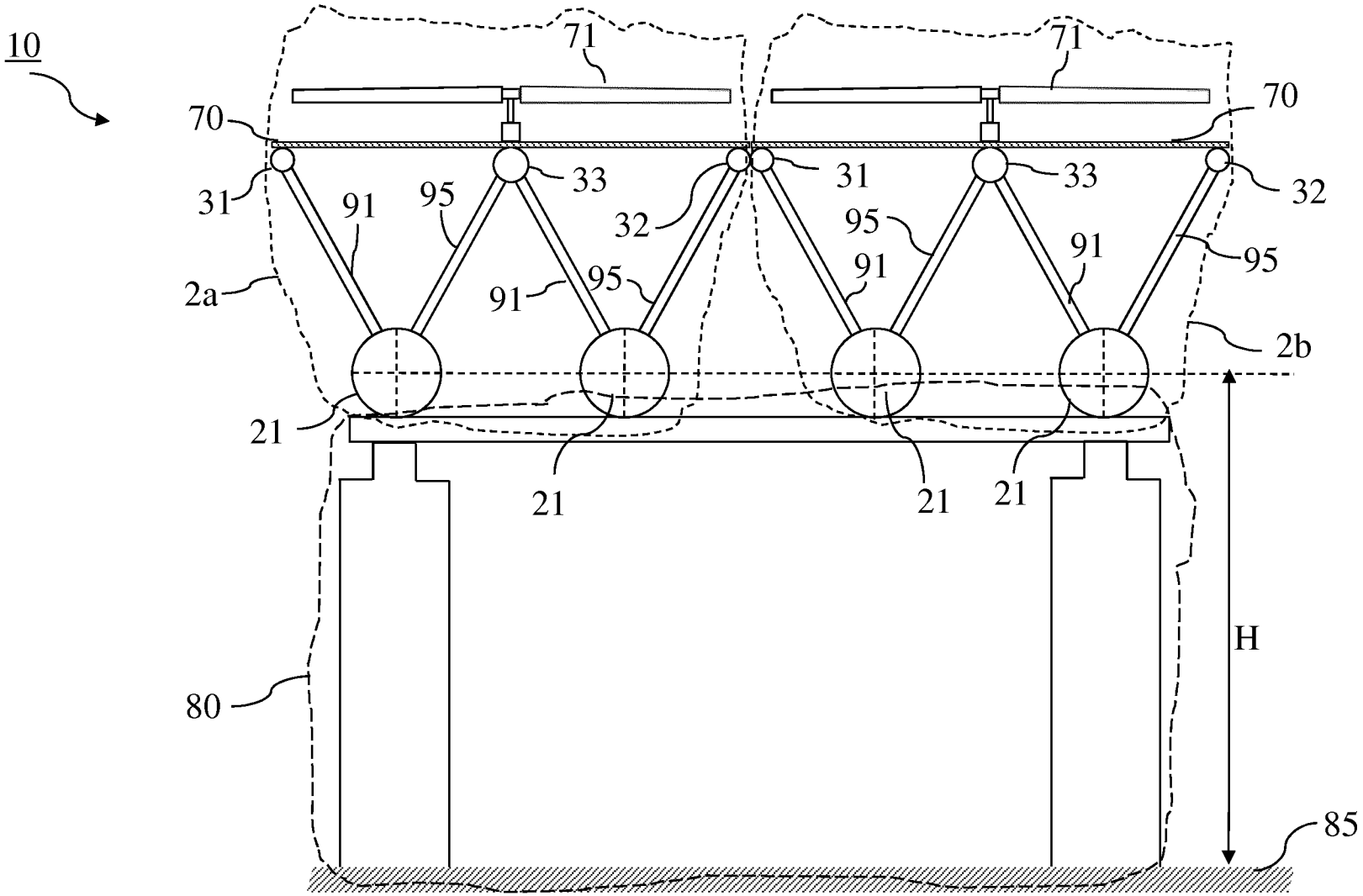

FIG. 7 shows a cross sectional view of a part of W-shaped heat exchanger;

FIG. 8 shows a cross sectional view of a part of an exemplary embodiment of a W-shaped heat exchanger;

FIG. 9 shows a front view of an example of an air-cooled condenser according to the invention;

FIG. 10 shows a side view of an understructure of an air-cooled condenser according to the invention;

FIG. 11 shows a front view of a further example of an air-cooled condenser according to the invention.

The figures are not drawn to scale. Generally, identical components are denoted by the same reference numerals in the figures.

DETAILED DESCRIPTION OF PREFERRED EMBODIMENTS

According to a first aspect of the invention a V-shaped heat exchanger for condensing exhaust steam from a turbine is provided.

Such a V-shaped heat exchanger for condensing exhaust steam from a turbine comprises a first set of primary tubes 91 and a second set of primary tubes 94. The primary tubes of the first set are single-row condensing tubes placed in parallel and inclined with an angle $\delta 1$ with respect to a vertical plane V, and wherein $15° < \delta 1 < 80°$. The primary tubes of the second set are single-row condensing tubes placed in parallel and inclined with an angle $\delta 2$ with respect to the vertical plane, and wherein $15° < \delta 2 < 80°$, and such that, as illustrated on FIG. 2, an opening angle $\delta = \delta 1 + \delta 2$ is formed between said first set of primary tubes 91 and said second set of primary tubes 94. In preferred embodiments, $20° < \delta 1 < 40°$ and $20° < \delta 2 < 40°$.

The single-row condensing tubes are state of the art condensing tubes which are commercially available. Each single-row condensing tube comprises a core tube having a cross sectional shape that is either circular, oval, rectangular or rectangular with half-round ends. The single-row condensing tubes further comprises fins attached to sides of the core tube. Typically, the cross section of a single-row tube is about 10 $cm^2$ to 60 $cm^2$. For example, a rectangular shaped tube has a typical cross section of 2 cm by 20 cm.

Figure 1:
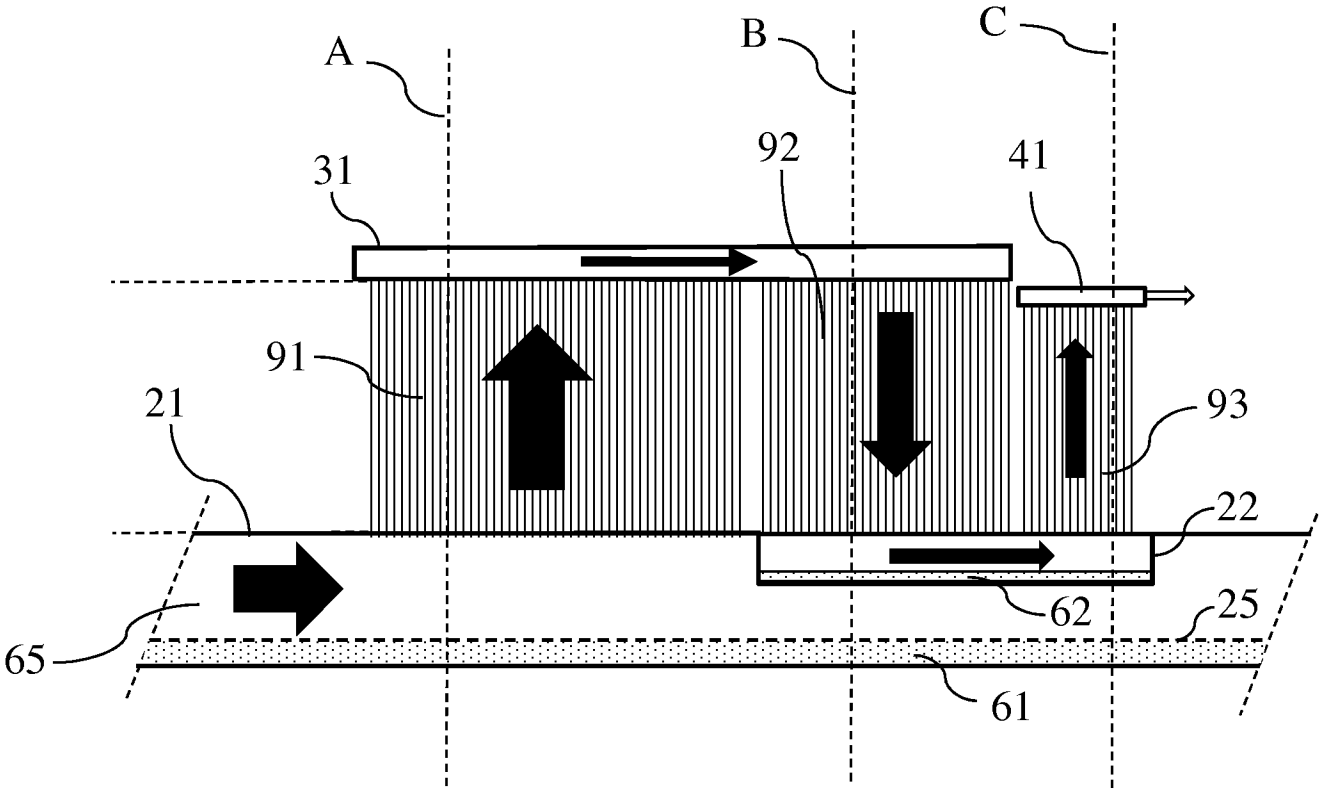
Figure 2:
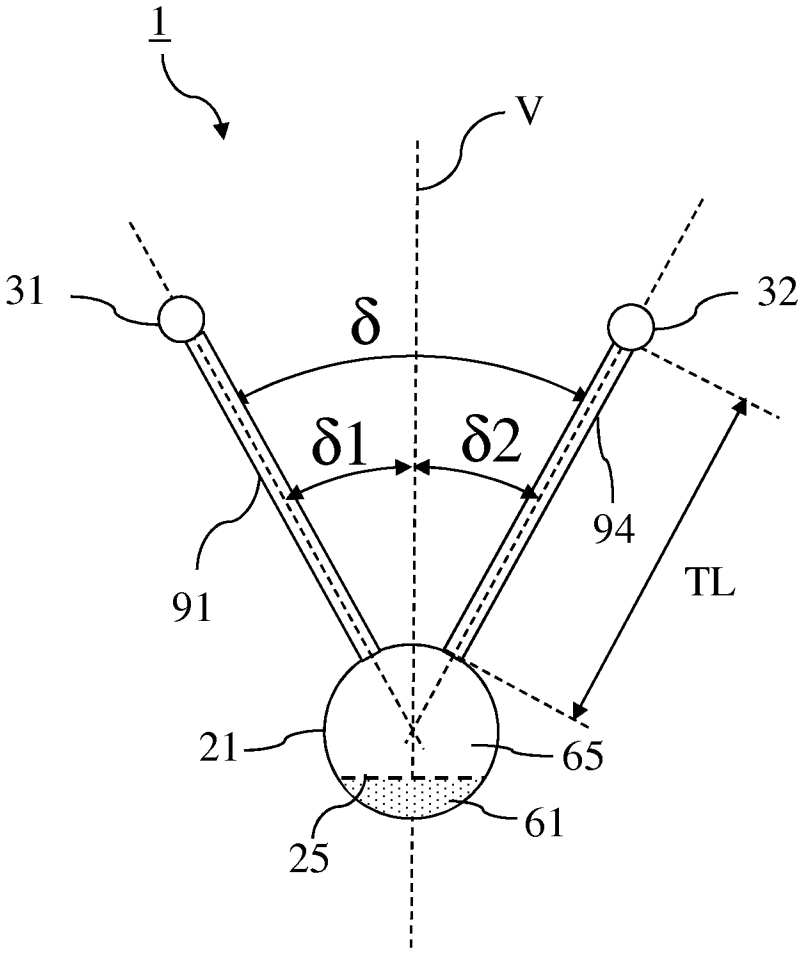
FIG. 2 shows a cross section of the V-shaped heat exchanger of FIG. 1 taken through a plane A.

As illustrated on FIG. 1 and FIG. 2, the V-shaped heat exchanger comprises a steam supply manifold 21 configured for receiving exhaust steam from the turbine. The steam supply manifold 21 is coupled with lower tube ends of the primary tubes of the first set of primary tubes 91 and coupled with lower tube ends of the primary tubes of the second set of primary tubes 94.

FIG. 2 shows a cross sectional view, taken through a plane A, of the V-shaped heat exchanger shown on FIG. 1. This figure illustrates the V-shaped position of the primary single-row condensing tubes and shows the angles 61 and 62 with respect to the vertical plane V.

The V-shaped heat exchanger according to the invention also comprises a first set of secondary tubes 92 and a second set of secondary tubes 95. The secondary tubes of the first set 92 are placed in parallel and inclined with the angle $\delta 1$ with respect to the vertical plane V and the secondary tubes of the second set 94 are placed in parallel and inclined with the angle $\delta 2$ with respect to the vertical plane such that the opening angle $\delta = \delta 1 + \delta 2$ is formed between the first set of secondary tubes 92 and the second set of secondary tubes 95. Both the secondary tubes of the first and the second set are single-row condensing tubes.

Figure 3:
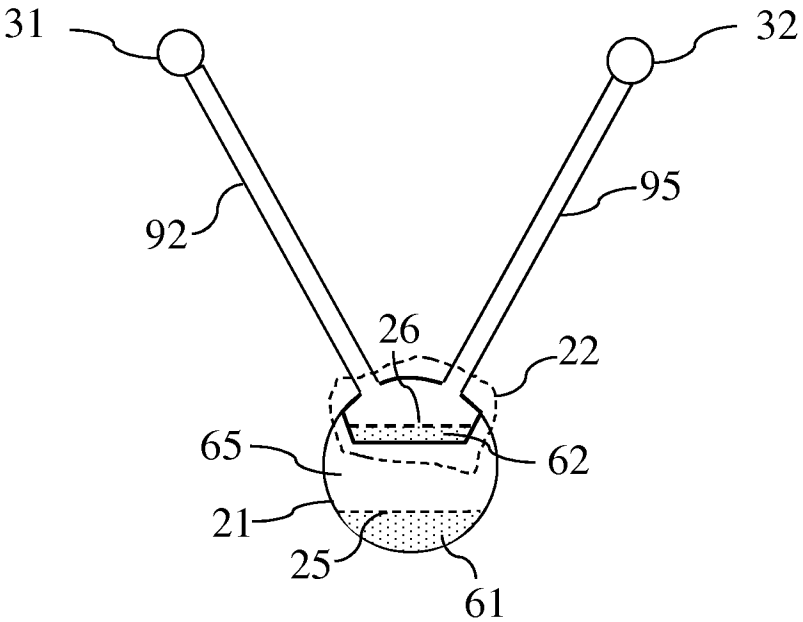
FIG. 3 shows a cross section of the V-shaped heat exchanger of FIG. 1 taken through a plane B.

FIG. 3 shows a cross sectional view of the V-shaped heat exchanger shown on FIG. 1 taken through a plane B, illustrating the V-shaped position of the secondary condensing tubes.

The V-shaped heat exchanger according to the invention further comprises at least a first set of tertiary tubes 93, wherein the tertiary tubes of the first set are placed in parallel and inclined with the angle δ1 with respect to the vertical plane V. Preferably, the tertiary tubes are also single-row condensing tubes.

The V-shaped heat exchanger 1 according to the invention is characterized in that it comprises, as illustrated on FIG. 2, a first top connecting manifold 31 and a second top connecting manifold 32.

The first top connecting manifold 31 is coupling upper tube ends of the primary tubes of the first set of primary tubes 91 with upper tube ends of the secondary tubes of the first set of secondary tubes 92. The second top connecting manifold 32 is coupling upper tube ends of the primary tubes of the second set of primary tubes 94 with upper tube ends of the secondary tubes of the second set of secondary tubes 95. With the coupling of the first and second connecting manifolds, primary and secondary condensing tubes are placed in series. In this way, steam that is not condensed in the primary tubes of the first set of primary tubes can flow, along with non-condensable gases, to the secondary tubes of the first set of secondary tubes and steam that is not condensed in the primary tubes of the second set of primary tubes can flow along with non-condensable gases to the secondary tubes of the second set of secondary tubes.

The V-shaped heat exchanger 1 according to the invention is characterized in that it comprises a bottom connecting manifold 22 coupled with lower tube ends of the secondary tubes of the first set of secondary tubes 92, coupled with lower tube ends of the secondary tubes of the second set of secondary tubes 95 and coupled with lower tube ends of the tertiary tubes of the at least first set of tertiary tubes 93. In this way, when in operation, remaining steam that is not condensed in the primary or secondary tubes can be transported via the bottom connecting manifold 22 to the tertiary tubes of the at least first set of tertiary tubes. This remaining steam can then be condensed in the tertiary tubes.

As illustrated on FIG. 1, the V-shaped heat exchanger 1 according to the invention comprises at least a first evacuation manifold 41 for evacuating non-condensable gases; The first evacuation manifold 41 is coupled with upper tube ends of the tertiary tubes of the at least first set of tertiary tubes 93.

As further illustrated on FIG. 1 and FIG. 2, the steam supply manifold 21 comprises a steam supply section 65 and a condensate drain section 61. The steam supply section 65 allows for transporting the exhaust steam to the lower tube ends of the primary tubes of the first 91 and second 94 set of primary tubes. The condensate drain section 61 allows for draining condensate from the primary tubes of the first set 91 and the second set 94 of primary tubes. Generally, the steam supply manifold 21 is slightly inclined such that condensate in the condensate drain section 61 flows under gravity in a direction opposite to the steam inflow direction.

Generally, the condensate drain section 61 comprises a first condensate output for coupling to a condensate collector tank. Typically a pipeline is used to make the coupling between the first condensate output and the condensate collector tank.

In embodiments, the condensate drain section 61 comprises a baffle 25 separating the steam supply section 65 from the condensate drain section 61. In this way the flow of the exhaust steam and the flow of the condensate are not mutually disturbed. The baffle 25, illustrated with a dotted line in FIG. 1 and FIG. 2, is located in a bottom part of the main steam supply manifold 21. Typically the baffle 25 comprises a plate with openings such that the condensate can fall down from the steam supply section 65 into the condensate drain section 61.

Figure 4:
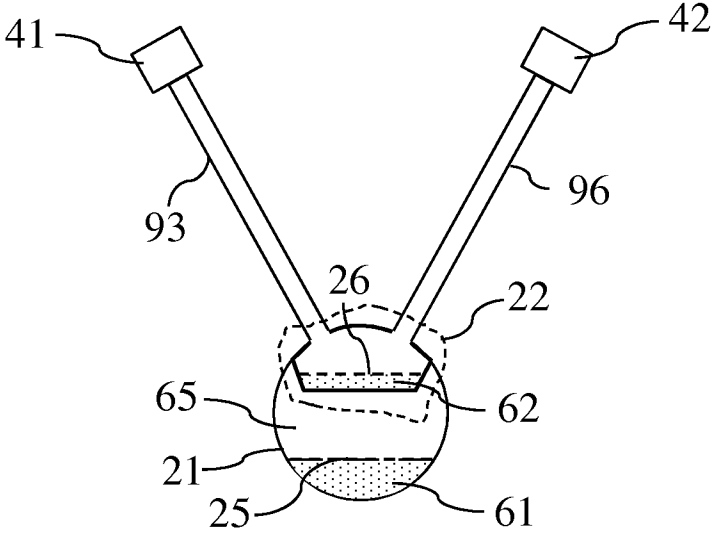
FIG. 4 shows part of a cross section of the V-shaped heat exchanger of FIG. 1 taken through a plane C.

As further illustrated on FIG. 1, FIG. 3 and FIG. 4, the bottom connecting manifold 22 comprises a draining means 62 configured for draining condensate from the secondary tubes of the first set 92 and second set of secondary tubes 95 and for draining condensate from tertiary tubes of the at least first set of tertiary tubes 93.

Generally, the draining means 62 comprises a second condensate output for coupling to the condensate collector tank. Typically, a further pipeline is used to make this coupling between the second condensate output and the condensate collector tank. In this way, all condensate is collected in a common condensate collector tank.

In preferred embodiments, as illustrated on FIG. 3, the V-shaped heat exchanger according to the invention comprises a second set of tertiary tubes 96, wherein the tertiary tubes of the second set are placed in parallel and inclined with the angle δ2 with respect to the vertical plane V. In this geometry, the opening angle δ=δ1+δ2 is also formed between the first set of tertiary tubes 93 and the second set of tertiary tubes 96.

In these preferred embodiments, the bottom connecting manifold 22 is also coupled with lower tube ends of the tertiary tubes of the second set of tertiary tubes 96. Preferably, the tertiary tubes of the second set of tertiary tubes 96 are also single-row condensing tubes. As schematically illustrated on FIG. 3, a second evacuation manifold 42 for evacuating non-condensable gases is coupled with upper tube ends of the tertiary tubes of the second set of tertiary tubes 96. In these preferred embodiments, the draining means 62 are further configured for draining condensate from tertiary tubes of the second set of tertiary tubes 96.

The operation of the heat exchanger according to the invention is further discussed. The heat exchanger for condensing exhaust steam from a turbine typically operates at a pressure in the range between 70 mbar and 300 mbar corresponding to a steam temperature in the range between 39° C. and 69° C. The black arrows on FIG. 1 represent the flow of steam and/or non-condensable gases through the V-shaped heat exchanger. When in operation, the exhaust steam from the turbine enters the main steam supply manifold 21 and the main steam supply manifold 21 redistributes the steam to the primary tubes of the first and second set of primary tubes. The steam and condensate in the primary tubes flow in an opposite direction. Indeed, the condensate formed in the primary tubes will flow by gravitation back to the main steam supply manifold 21 where the condensate drain section 61 collects and drains the condensate. This mode of operation is called counter-flow mode. The primary tubes perform a first stage of the condensing process.

The remaining steam that is not condensed after a single passage through a primary condensing tube of the first set of primary tubes is collected in the first top connecting manifold 31. Similar, remaining steam that is not condensed after a single passage through a primary condensing tube of the second set of primary tubes is collected by the second top connecting manifold 32. The first top connecting manifold 31 and the second top connecting manifold 32 supply the remaining steam to the secondary tubes of respectively the first and second set of secondary tubes. The secondary condensing tubes operate in a so-called co-current mode wherein the steam and the formed condensate flow in the same direction. The secondary tubes perform a second stage of the condensing process.

The bottom connecting manifold 22 collects the remaining steam that is nor condensed in the primary tubes nor condensed in the secondary tubes and transports this remaining steam to the tertiary tubes.

The tertiary tubes also operate in the counter-current mode. The tertiary tubes perform a third and last stage of the condensing process. During the three condensing stages, non-condensable gases are also flowing through the sequence of condensing tubes and are collected and evacuated by the evacuation manifold for non-condensable gases.

When in operation, the non-condensable gases are swept into the upper region of the tertiary tubes where they can be removed. The evacuation manifold comprises an ejector for extracting the non-condensable gases.

Typically, a vacuum pump is coupled to the first evacuation manifold 41 and/or the second evacuation manifold 42 for pumping the non-condensable gases and blowing them in the atmosphere. These type of evacuation manifolds for extracting non-condensable gases are known in the art and are used for example for a dephlegmator stage (also named reflux), also operating in a counter-current mode, of a classical delta-type heat exchanger.

In the embodiments according to the invention, the condensing tubes are configured such that the majority of the exhaust steam is condensed in the primary tubes (typically 60% to 80%) and a further fraction is condensed in the secondary tubes (typically 10% to 30%). In the tertiary tubes only a small fraction of the total exhaust steam is condensed (typically 10% or less). The amount of steam that is condensed in the three condensing stages is determined by the number of primary, secondary and tertiary tubes.

Typically the primary and secondary tubes of the heat exchanger according to the invention have a tube length TL in the range of 4 meter≤TL≤7 meter. In preferred embodiments, the tube length is between 4.5 and 5.5 m. In some embodiments, as schematically illustrated on FIG. 1, the length of the condensing tubes of the tertiary tubes is shorter than the length of the primary tubes and the secondary tubes. In this embodiment, the shorter length allows for example to install the evacuation manifold as illustrated on FIG. 1. In other embodiments, as illustrated on FIG. 6*a* and FIG. 6*b*, the tube length of the tertiary tubes is the same as the tube length of the primary and secondary tubes.

A known phenomenon when using a heat exchanger in a counter-current mode is the so-called flooding phenomenon that can block or partly block the flow of the steam through the tubes. This results in a large pressure drop. The flooding occurs when the steam entering the condensing tubes has a high velocity and as result forces the condensate to reorient in an upward direction. To address this flooding problem, the heat exchanger is to be designed such that a critical velocity where the flooding occurs is not reached.

As discussed above, prior art heat exchangers, such as for example delta-type heat exchangers operating in a co-current mode, typically use condensing tubes having a tube length between 10 and 12 meter. A typical velocity of the steam entering the condensing tubes of these delta-type heat exchangers is about 100 m/s. Using such long tube length of 10 meter as primary tubes for the heat exchanger according to the invention could be critical for what concerns the flooding problem.

If the length of the condensing tubes is reduced by for example a factor of two, in order to maintain the same heat exchange surface and hence the same heat exchange capacity, the number of condensing tubes needs to be doubled. The advantage in doing so is that the velocity of the steam entering the condensing tubes is also reduced by about a factor of 2.

Therefore, in preferred embodiments according to the invention, the tube length TL of the primary tubes is in the range of 4 meter TL 7 meter. In this way, the velocity of the steam entering the tubes is reduced when compared to the long tubes of 10 to 12 meter of classical delta-type heat exchangers and problems related to flooding can be avoided.

A further advantage of the reduced velocity of the steam is that the pressure drop in the heat exchanger is reduced and hence the performance of the heat exchanger is improved. Indeed, the pressure drop in a condensing tube is proportional with the square of the entrance velocity of the steam. Therefore, if reducing the velocity of the steam entering a condensing tube by a factor of two, the pressure drop in a condensing tube is reduced by a factor of four.

Hence, although the heat exchanger according to the invention is using three condensing stages with primary, secondary and tertiary tubes, the total pressure drop is still lower when compared to the total pressure drop in for example a classical delta-type heat exchanger where two condensing stages are used: a first stage heat exchanger in co-current mode and a second stage dephlegmator in counter-current mode.

In practice, a number of parallel single-row condensing tubes are grouped together to form a tube bundle. A first tube plate and a second tube plate is respectively welded to the lower and upper ends of the tubes of the bundle. The tube plates are thick-walled metal sheets with holes. The first tube plate is then welded to the steam supply manifold and the second tube plate is welded to a top manifold. In this way the coupling between the manifolds and the condensing tubes is established. This coupling between the tubes and the manifolds has to be construed as a fluid-tight coupling such that leaks in the heat exchanger are minimized.

The width W of the tube bundle is determined by the number of condensing tubes in the bundle. In some embodiments, the tube bundles have a same standard width W of for example 2.5 m, which facilitates the manufacturing process of the various tube bundles.

The sets of primary, secondary and tertiary tubes can comprise a different number of tube bundles. For example, in the embodiment shown on FIG. 6*a*, the first set of primary tubes 91 comprises six tube bundles having a width W and are referenced by the numbers 91*a*, 91*b*, 91*c*, 91*d*, 91*e* and 91*f*. The first set of secondary tubes 92 comprises two tube bundles, also having a width W, and identified with reference numbers 92*a* and 92*b*. The first set of tertiary tubes 93 comprises one tube bundle 93*a* which in this example also has the same width W. In this embodiment, as further illustrated on FIG. 6*b*, the second set of primary tubes 94 comprises six tube bundles referenced by the numbers 94*a*, 94*b*, 94*c*, 94*d*, 94*e* and 94*f*, the second set of secondary tubes 95 comprises two tube bundles 95*a* and 95*b* and the secondary set of tertiary tubes 96 comprises one tube bundle 96*a*.

As schematically illustrated on FIG. 2 and FIG. 6*a*, the length of the tube bundles is determined by the length TL of the single-row condensing tubes.

As illustrated in FIG. 6*a* and FIG. 6*b*, the first top connecting manifold 31 and the second top connecting manifold can comprise various sub-manifolds. In the example shown on FIG. 6*a*, the first top manifold 31 comprises two sub-manifolds 31*a* and 31*b* and as shown on FIG. 6*b*, the second top connection manifold 32 comprises two sub-manifolds 32*a* and 32*b*.

In embodiments, as illustrated on FIG. 3 and FIG. 4, the steam supply manifold 21 comprises a separated compartment forming the bottom connecting manifold 22. In other words, the bottom connecting manifold 22 is integrated inside the steam supply manifold 21. For example, the separated compartment can be obtained by welding one or more metal plates inside the steam supply manifold 21. As the steam supply manifolds typically have a diameter between one and three meter, welding the plates on the inside of the steam supply manifold to form the bottom connecting manifold 22 is a cost-effective way to perform this activity at the site of installation.

As mentioned above, the bottom connecting manifold 22 comprises a draining means 62 configured for draining condensate from the secondary and tertiary tubes. The draining means 62 has to be construed as a channel or trench for draining the condensate. Typically, the bottom connecting manifold 22 comprises an upper and a lower section. The lower section is forming the draining means 62. In some embodiments, a further baffle can be used to separate this lower section from the upper section. In this way, the flow of steam from the secondary tubes to the tertiary tubes in the upper section is separated from the flow from the condensate in the lower section. The condensate drained with the draining means 62 is further transported via a further duct to the condensate collector tank (not shown on the figures).

In the embodiments shown on FIG. 3 and FIG. 4, the bottom connecting manifold 22 is formed by a single cavity that is receiving remaining steam from the secondary tubes of both the first and second set of secondary tubes. As shown on FIG. 4, in this embodiment, the lower tube ends of the tertiary tubes of the first and second set of tertiary tubes are also connected to this single cavity for receiving the remaining steam and non-condensable gases coming from the first and second set of secondary tubes.

Figure 5:
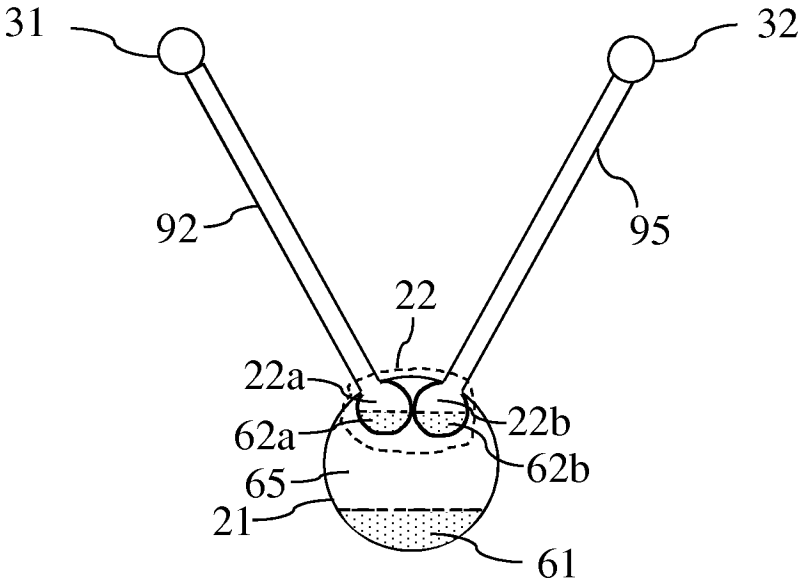
FIG. 5 shows a cross sectional view of a part of an alternative embodiment of a V-shaped heat exchanger according to the invention.

In alternative embodiments, illustrated on FIG. 5, the bottom connecting manifold 22 is formed by two separated cavities. In this embodiment, the bottom connecting manifold comprises a first connecting part 22*a* and a second connecting part 22*b* corresponding to the two cavities. The first connecting part 22*a* is connecting the lower tube ends of the secondary tubes of the first set of secondary tubes 92 with the lower tube ends of the tertiary tubes of the first set of tertiary tubes 93. The second connecting part 22*b* is connecting the lower tube ends of the secondary tubes of the second set of secondary tubes 94 with the lower tube ends of the tertiary tubes of the second set of tertiary tubes 96. The first and second connecting part can for example be formed by welding a first and a second tube element on the inside of the main steam supply manifold. In this way, two separate cavities are formed within the main steam supply manifold.

In these alternative embodiments, shown on FIG. 5, the first connecting part 22*a* and the second connecting part 22*b* comprise respectively a first 62*a* and a second 62*b* drain compartment. This first 62*a* and second 62*b* drain compartment are forming the draining means 62 of the bottom distribution manifold 22.

Generally, due to a pressure drop in the heat exchanger, the pressure in the bottom connecting manifold 22 is lower than the pressure in the steam supply manifold. As a consequence, the temperature of the condensate in the bottom connecting manifold is also lower than the temperature of the condensate in the steam supply manifold. Therefore, integrating the bottom connecting manifold inside the steam supply manifold gives an advantage that the condensate in the bottom connecting manifold is in contact, through the walls of the bottom connecting manifold, with the exhaust steam in the steam supply manifold. This has the advantage effect that the temperature of the condensate in the bottom connection manifold is increased. In this way, sub-cooling of the condensate is minimized.

However, the bottom connecting manifold 22 is not necessarily integrated inside the steam supply manifold 21. For example, in other embodiments, the steam supply manifold 21 is reduced in diameter at the location of the secondary and tertiary tubes to allow to install a bottom connecting manifold 22 that is coupled to the secondary and tertiary tubes but that is separated from the main steam supply manifold 21.

The invention is also related to a so-called W-shaped heat exchanger 2 for condensing exhaust steam from a turbine. Such a W-shaped heat exchanger 2, as illustrated on FIG. 7 and FIG. 8, comprises a first V-shaped heat exchanger 1*a* and a second V-shaped heat exchanger 1*b* placed adjacently to the first V-shaped heat exchanger 1*a*. The steam supply manifold of the first V-shaped heat exchanger 1*a* is parallel with the steam supply manifold of the second V-shaped heat exchanger 1*b*.

In a preferred embodiment of a W-shaped heat exchanger 2, as illustrated on FIG. 8, the second top connecting manifold of the first V-shaped heat exchanger 1*a* and the first top connecting manifold of the second V-shaped heat exchanger 1*b* are forming a single common 33 top connecting manifold for the first 1*a* and the second 1*b* V-shaped heat exchanger. Using a common top connecting manifold 33 increase the strength of the heat exchanger.

The invention also relates to an air-cooled condenser 10 comprising a V-shaped heat exchanger as discussed above and wherein a condensate collector tank is coupled with the condensate drain section 61 of the steam supply manifold 21 and coupled with the draining means 62 of the bottom connecting manifold 22. In this way, all condensate that is formed in the heat exchanger is collected in a common collector tank.

As illustrated with FIG. 9 and FIG. 11, the invention is also related to an air cooled condenser 10 comprising a W-shaped heat exchanger 2 and a support understructure 80 configured for elevating the W-shaped heat exchanger 2 with respect to a ground floor 85. The W-shaped air cooled condenser 10 further comprises a fan support assembly supporting a fan 71. The fan 71 is configured for inducing an air draft through the W-shaped heat exchanger. The fan support assembly comprises a fan deck 70 coupled to the top connecting manifolds of the W-shaped heat exchanger 2.

Typically, the support understructure 80 of the air cooled condenser 10 is configured to elevate each of the steam supply manifolds 21 at a height H>4 m with respect to the ground floor 85.

a. Advantageously, due to this V-shaped geometry of the heat exchangers and due to the use of steam supply manifolds located in the vertex region of the V-shaped heat exchangers, both the support understructure and the fan support structure can be simplified when compared to prior art air cooled condensers such as described in US2017/0234168A1. With the V-shaped or W-shaped heat exchanger according to the invention, there is no need of a support bracket extending in a longitudinal direction parallel to the steam supply lines as is the case in US2017/0234168A1. Indeed with the heat exchanger according to the invention, the steam supply manifolds act as the longitudinal support structure and the support understructure only extends in a direction perpendicular to the steam supply manifolds as further illustrated in FIG. 10 showing part of a side view of an understructure supporting the steam supply manifold. With this simplified understructure the number of steel needed is strongly reduced. In addition, as discussed above the fans 71 can be supported through a fan deck located on top of the top connecting manifolds such that no specific central pillar is needed as in US2017/0234168A1 to support a fan.

In other embodiments, as illustrated on FIG. 11, the air cooled condenser 10 comprises two or more W-shaped heat exchangers 2*a* and 2*b*. The two or more W-shaped heat exchangers 2*a*,2*b* are placed adjacently to each other such that the steam supply manifolds 21 of each of the one or more W-shaped heat exchanger are parallel. Also for these embodiments, a support understructure 80 is configured for elevating the two or more W-shaped heat exchangers 2 with respect to a ground floor 85. One or more fans 71 configured for inducing an air draft through the two or more W-shaped heat exchangers are provided and a support assembly 50 supports the one or more fans.

According to a further aspect of the invention a method is provided for condensing exhaust steam from a turbine using an air-cooled condenser. The method comprises steps of providing a first set of primary tubes 91, wherein the primary tubes of the first set are single-row condensing tubes placed in parallel and inclined with an angle δ1 with respect to a vertical plane V, and wherein 15°<δ1<80°, preferably 20°<81<40°, providing a second set of primary tubes 94, wherein the primary tubes of the second set are single-row condensing tubes placed in parallel and inclined with an angle δ2 with respect to said vertical plane V, and wherein 15°<δ2<80°, preferably 20°<δ2<40°, and wherein an opening angle δ=δ1+δ2 is formed between said first set of primary tubes 91 and said second set of primary tubes 94, providing a first set of secondary tubes 92, wherein the secondary tubes of the first set are single-row condensing tubes placed in parallel and inclined with said angle δ1 with respect to said vertical plane V, providing a second set of secondary tubes 95, wherein the secondary tubes of the second set are single-row condensing tubes placed in parallel and inclined with said angle δ2 with respect to said vertical plane V such that the opening angle δ=δ1+δ2 is formed between said first set of secondary tubes 92 and said second set of secondary tubes 95, providing at least a first set of tertiary tubes 93, wherein the tertiary tubes of the first set are placed in parallel and inclined with said angle δ1 with respect to said vertical plane V, preferably said tertiary tubes are single-row condensing tubes, supplying the exhaust steam to lower ends of the primary tubes of said first set of primary tubes 91 and said second set 94 of primary tubes, collecting at upper ends of the primary tubes of the first set of primary tubes a first remaining steam that is not condensed in the first set of primary tubes and supplying said first remaining steam to upper ends of said secondary tubes of said first set of secondary tubes 92, collecting at upper ends of the primary tubes of the second set of primary tubes 94 a second remaining steam that is not condensed in the second set of primary tubes and supplying said second remaining steam to upper ends of secondary tubes of said second set of secondary tubes 95, collecting at lower ends of the secondary tubes of the first and second set of secondary tubes a further remaining steam that is not condensed in the secondary tubes of the first and second set of secondary tubes and supplying said further remaining steam to lower ends of said tertiary tubes of said at least first set of tertiary tubes 93, evacuating non-condensable gases at upper ends of the tertiary tubes of the at least first set of tertiary tubes 93, collecting condensate from the primary tubes of the first and second set of primary tubes, from the secondary tubes of the first and second set of secondary tubes and from the tertiary tubes of the at least first set of tertiary tubes and draining the collected condensate towards a condensate collector tank.

The present invention has been described in terms of specific embodiments, which are illustrative of the invention and not to be construed as limiting. More generally, it will be appreciated by persons skilled in the art that the present invention is not limited by what has been particularly shown and/or described hereinabove. The invention resides in each and every novel characteristic feature and each and every combination of characteristic features. Reference numerals in the claims do not limit their protective scope.

Use of the verb "to comprise" does not exclude the presence of elements other than those stated.

Use of the article "a", "an" or "the" preceding an element does not exclude the presence of a plurality of such elements.

The invention claimed is:

1. A V-shaped heat exchanger for condensing exhaust steam from a turbine, the V-shaped heat exchanger comprising:

a first set of primary tubes, wherein the primary tubes of the first set are single-row condensing tubes placed in parallel and inclined with an angle δ1 with respect to a vertical plane (V), and wherein 15°<δ1<80°, a second set of primary tubes, wherein the primary tubes of the second set are single-row condensing tubes placed in parallel and inclined with an angle δ2 with respect to said vertical plane (V), and wherein 15°<δ2<80°, and wherein an opening angle δ=δ1+δ2 is formed between said first set of primary tubes and said second set of primary tubes, a steam supply manifold coupled with lower tube ends of the primary tubes of the first set of primary tubes and coupled with lower tube ends of the primary tubes of the second set of primary tubes, and wherein said steam supply manifold includes:

a) a steam supply section for transporting the exhaust steam to the lower tube ends of the primary tubes of the first and second set of primary tubes, and a condensate drain section configured for draining condensate from the primary tubes of the first set and the second set of primary tubes, a first set of secondary tubes, wherein the secondary tubes of the first set are single-row condensing tubes placed in parallel and inclined with said angle δ1 with respect to said vertical plane (V), a second set of secondary tubes, wherein the secondary tubes of the second set are single-row condensing tubes placed in parallel and inclined with said angle δ2 with respect to said vertical plane (V) such that the opening angle $\delta=\delta 1+\delta 2$ is formed between said first set of secondary tubes and said second set of secondary tubes, at least a first set of tertiary tubes, wherein the tertiary tubes of the first set are placed in parallel and inclined with said angle $\delta 1$ with respect to said vertical plane (V), a first top connecting manifold coupling upper tube ends of the primary tubes of the first set of primary tubes with upper tube ends of the secondary tubes of the first set of secondary tubes, a second top connecting manifold coupling upper tube ends of the primary tubes of the second set of primary tubes with upper tube ends of the secondary tubes of the second set of secondary tubes, a bottom connecting manifold coupled with lower tube ends of the secondary tubes of the first set of secondary tubes, coupled with lower tube ends of the secondary tubes of the second set of secondary tubes and coupled with lower tube ends of the tertiary tubes of the at least first set of tertiary tubes, at least a first evacuation manifold for evacuating non-condensable gases, wherein said first evacuation manifold is coupled with upper tube ends of the tertiary tubes of the at least first set of tertiary tubes, and wherein said bottom connecting manifold includes:

a drain configured for draining condensate from the secondary tubes of the first set and the second set of secondary tubes and for draining condensate from tertiary tubes of the at least first set of tertiary tubes.

2. A V-shaped heat exchanger according to claim 1 further including:

a second set of tertiary tubes, wherein the tertiary tubes of the second set are placed in parallel and inclined with said angle $\delta 2$ with respect to said vertical plane (V) such that the opening angle $\delta=\delta 1+\delta 2$ is formed between said first set of tertiary tubes and said second set of tertiary tubes, and wherein said bottom connecting manifold is coupled with lower tube ends of the tertiary tubes of said second set of tertiary tubes, and a second evacuation manifold for evacuating non-condensable gases, wherein said second evacuation manifold is coupled with upper tube ends of the tertiary tubes of the second set of tertiary tubes, and wherein said drain is further configured for draining condensate from tertiary tubes of the second set of tertiary tubes.

3. A V-shaped heat exchanger according to claim 1 wherein said steam supply manifold includes a baffle separating the steam supply section from the condensate drain section.

4. A V-shaped heat exchanger according to claim 1 wherein said steam supply manifold includes a separated compartment forming said bottom connecting manifold.

5. A V-shaped heat exchanger according to claim 4 wherein said separated compartment is obtained by welding one or more metal plates inside said steam supply manifold.

6. A V-shaped heat exchanger according to claim 1 wherein said bottom connecting manifold includes a lower compartment forming said draining means.

7. A V-shaped heat exchanger according to claim 2 wherein said bottom connecting manifold includes a first connecting part and a second connecting part, and wherein said first connecting part is connecting lower tube ends of the secondary tubes of the first set of secondary tubes with lower tube ends of the tertiary tubes of the first set of tertiary tubes, and wherein said second connecting part is connecting lower tube ends of the secondary tubes of the second set of secondary tubes with lower tube ends of the tertiary tubes of the second set of tertiary tubes.

8. A V-shaped heat exchanger according to claim 7 wherein said first connecting part and said second connecting part include respectively a first and a second condensate drain collector and wherein said first and second condensate drain collector form said drain of the bottom connecting manifold.

9. A V-shaped heat exchanger according to claim 1 wherein the primary tubes of the first set of primary tubes are grouped in one or more primary tube bundles, wherein the primary tubes of the second set of primary tubes are grouped in one or more further primary tube bundles, wherein the secondary tubes of the first set of secondary tubes are grouped in one or more secondary tube bundles, wherein the secondary tubes of the second set of secondary tubes are grouped in one or more further secondary tube bundles and wherein the tertiary tubes of the first set of tertiary tubes are grouped in one or more tertiary tube bundles and/or wherein the tertiary tubes of the second set of tertiary tubes are grouped in one or more further tertiary tube bundles.

10. A V-shaped heat exchanger according to claim 1 wherein said condensate drain section includes a first condensate output for coupling to a condensate collector tank, and wherein said drain includes a second condensate output for coupling to the condensate collector tank.

11. A V-shaped heat exchanger according to claim 1 wherein the primary tubes of the first set and the second set of primary tubes and the secondary tubes of the first set and second set of secondary tubes have a tube length in a range between 4 meters and 7 meters.

12. A W-shaped heat exchanger for condensing exhaust steam from a turbine, the W-shaped heat exchanger comprising:

a first V-shaped heat exchanger according claim 1, and a second V-shaped heat exchanger according to claim 1 placed adjacently to said first V-shaped heat exchanger and wherein the steam supply manifold of the first V-shaped heat exchanger is positioned parallel with the steam supply manifold of the second V-shaped heat exchanger.

13. A W-shaped heat exchanger according to claim 12 wherein the second top connecting manifold of the first V-shaped heat exchanger and the first top connecting manifold of the second V-shaped heat exchanger form a single common top connecting manifold for the first and the second V-shaped heat exchanger.

14. An air-cooled condenser comprising:

a W-shaped heat exchanger according to claim 12, a support understructure configured for elevating the W-shaped heat exchanger with respect to a ground floor, and a fan configured for supplying cooling air to the W-shaped heat exchanger.

15. An air-cooled condenser comprising:

a V-shaped heat exchanger according to claim 1; and a condensate collector tank coupled with said condensate drain section of the steam supply manifold and coupled with said drain of the bottom connecting manifold.

16. A method for condensing exhaust steam from a turbine using an air-cooled condenser, the method comprising:

providing a first set of primary tubes, wherein the primary tubes of the first set are single-row condensing tubes placed in parallel and inclined with an angle $\delta 1$ with respect to a vertical plane (V), and wherein $15° < \delta 1 < 80°$, providing a second set of primary tubes, wherein the primary tubes of the second set are single-row condensing tubes placed in parallel and inclined with an angle δ2 with respect to said vertical plane (V), and wherein 15°<δ2<80°, and wherein an opening angle δ=δ1+δ2 is formed between said first set of primary tubes and said second set of primary tubes, providing a first set of secondary tubes, wherein the secondary tubes of the first set are single-row condensing tubes placed in parallel and inclined with said angle δ1 with respect to said vertical plane (V), providing a second set of secondary tubes, wherein the secondary tubes of the second set are single-row condensing tubes placed in parallel and inclined with said angle δ2 with respect to said vertical plane (V) such that the opening angle δ=δ1+δ2 is formed between said first set of secondary tubes and said second set of secondary tubes, providing at least a first set of tertiary tubes, wherein the tertiary tubes of the first set are placed in parallel and inclined with said angle δ1 with respect to said vertical plane (V), supplying the exhaust steam to lower ends of the primary tubes of said first set of primary tubes and said second set of primary tubes, collecting at upper ends of the primary tubes of the first set of primary tubes a first remaining steam that is not condensed in the first set of primary tubes and supplying said first remaining steam to upper ends of said secondary tubes of said first set of secondary tubes, collecting at upper ends of the primary tubes of the second set of primary tubes a second remaining steam that is not condensed in the second set of primary tubes and supplying said second remaining steam to upper ends of secondary tubes of said second set of secondary tubes, collecting at lower ends of the secondary tubes of the first and second set of secondary tubes a further remaining steam that is not condensed in the secondary tubes of the first and second set of secondary tubes and supplying said further remaining steam to lower ends of said tertiary tubes of said at least first set of tertiary tubes, evacuating non-condensable gases at upper ends of the tertiary tubes of the at least first set of tertiary tubes, and collecting condensate from the primary tubes of the first and second set of primary tubes, from the secondary tubes of the first and second set of secondary tubes and from the tertiary tubes of the at least first set of tertiary tubes and draining the collected condensate towards a condensate collector tank.

17. A V-shaped heat exchanger according to claim 1, wherein:

20°<δ1<40°,

20°<δ2<40°, and said tertiary tubes are single-row condensing tubes.

18. A V-shaped heat exchanger according to claim 2, wherein said tertiary tubes of the second set are single-row condensing tubes.

19. A method according to claim 16, wherein:

20°<δ1<40°,

20°<δ2<40°, and said tertiary tubes are single-row condensing tubes.

* * * * *